US006865816B1

(12) United States Patent
Zajdel

(10) Patent No.: US 6,865,816 B1
(45) Date of Patent: Mar. 15, 2005

(54) REPLACEABLE BLADE UTILITY KNIFE WITH MAGNETIC ACTUATOR

(75) Inventor: Robert Zajdel, Castro Valley, CA (US)

(73) Assignee: Orcon Corporation, Union City, CA (US)

( * ) Notice: Subject to any disclaimer, the term of this patent is extended or adjusted under 35 U.S.C. 154(b) by 0 days.

(21) Appl. No.: 09/426,940

(22) Filed: Oct. 22, 1999

(51) Int. Cl.[7] ..... B26B 5/00

(52) U.S. Cl. ..... 30/330; 30/162; 30/335; 30/339

(58) Field of Search ..... 30/151, 162, 329, 30/330, 331, 335, 336, 337, 338, 339, 340

(56) References Cited

U.S. PATENT DOCUMENTS

| | | | | |
|---|---|---|---|---|
| 3,667,122 A | | 6/1972 | Black | 30/286 |
| 4,517,741 A | | 5/1985 | Castelluzzo | 30/162 |
| 4,575,940 A | | 3/1986 | Wenzel | 30/335 |
| 4,662,070 A | * | 5/1987 | Reddig | 30/332 X |
| 4,713,884 A | | 12/1987 | Dunnagan | 30/294 |
| 4,941,260 A | | 7/1990 | Castelluzzo | 30/162 |
| 5,168,630 A | | 12/1992 | Weber | 30/330 |
| 5,301,428 A | | 4/1994 | Wilcox | 30/162 |
| 5,806,189 A | | 9/1998 | Bailey | 30/125 |
| 5,815,866 A | * | 10/1998 | Janky | 7/114 |
| 5,940,970 A | * | 8/1999 | D'Ambro et al. | 30/330 X |
| 6,233,830 B1 | * | 5/2001 | Lamond et al. | 30/340 X |

FOREIGN PATENT DOCUMENTS

| | | |
|---|---|---|
| GB | 29596 | 5/1914 |

* cited by examiner

*Primary Examiner*—Clark F. Dexter
(74) *Attorney, Agent, or Firm*—O'Melveny & Myers LLP

(57) ABSTRACT

A replaceable blade utility knife is disclosed that uses permanent magnet to facilitate opening the knife handle for blade replacement. The utility knife has a handle made of two halves. The halves are held together by a connector, and rotate around the connector when the knife handle is opened. Permanent magnets are mounted in each half of the knife handle to separate the halves, rotate the halves to the desired open position, and to hold the halves in position while the blades are being changed. The permanent magnets act as a magnetic actuator for opening the handle halves.

19 Claims, 2 Drawing Sheets

REPLACEABLE BLADE UTILITY KNIFE WITH MAGNETIC ACTUATOR

BACKGROUND OF THE INVENTION

1. Field of the Invention

The invention relates generally to utility knives with replaceable blades, especially such knives used by those in the construction trades. Such knives include a handle and a blade holder for securing a thin elongated blade, such as a razor blade, in position for cutting. The handle and blade holder are designed to accommodate frequent changing of the razor blade as it dulls during use.

2. Description of the Related Art

Carpet layers have long used replaceable blade knives of various designs for cutting carpet and carpet pad to size during installation of wall-to-wall carpeting. It is important that the cutting blade be razor-sharp to make precise cuts and avoid damaging the carpet. The large number of cuts required and the nature of the materials used in many carpets rapidly dulls the knife blades. Thus, it is necessary to change the razor blades frequently during the course of a job. Other work is similar to carpet installation in that a utility knife is used for cutting materials, and frequent changing of the knife blade is required. Replaceable blade knives, called utility knives, are designed to hold razor blades securely while at the same time permitting easy changing of the razor blades.

Various utility knives are known in the art. U.S. Pat. No. 4,575,940 (Wenzel, 1986), incorporated herein by reference, discloses a utility knife designed for securely holding a razor blade while enabling easy blade changes. Wenzel's knife is designed so that the knife handle may be opened by the loosening of a single thumbscrew. The thumbscrew is driven by a 'D' ring in the head of the screw. The 'D' ring folds into a recess in the knife handle so that the head of the thumbscrew does not protrude from the handle while the knife is being used. The knife handle includes a compartment for retaining spare blades. The blade in Wenzel's knife is not retractable into the handle.

A knife configured specifically for cutting carpet pad is disclosed by U.S. Pat. No. 4,713,884 (Dunnagan, 1987), which is incorporated herein by reference. Dunnagan's knife is similar to Wenzel's knife. It differs in that the shape of the handle and configuration of the blade are specifically designed for cutting carpet pad instead of carpet or other materials, and in other details. However, it is another example of a non-retractable, replaceable blade knife (like Wenzel's knife) with two handle halves held together by a single connector. Connectors for these types of knives are often designed to be loosened and tightened by hand, eliminating the need for a screwdriver or other tool.

Retractable utility knives are also frequently made with two handle halves that are held together by a single connector. An example is described in U.S. Pat. No. 5,301,428 (Wilcox, 1994). Many similar examples may be found in the art and knives of this type are in widespread commercial use.

An important reason for this two-piece, single connector design for utility knives (of both retractable and non-retractable blade types) is to facilitate replacement of the knife blade. Opening the knife handle unclamps the cutting blade and permits its removal and replacement. Opening the handle also permits access to the spare blades that are frequently stored in the handle of such knives. The conmnonality of the basic two-piece, single connector design across a wide variety of utility knives shows that the design concept is successful in practice, and that ease of blade replacement is an important feature for such knives.

However, blade replacement in prior art utility knives, particularly the opening of the handle halves, is not optimal. Commonly, the two halves of the handle tend to stick together after the connector is loosened. The halves must then be manually separated, and sometimes become suddenly unstuck, causing the razor-sharp blades to spill from the handle. Even when the halves are not stuck together, manual dexterity and mental concentration are required to slide them apart and hold them open the proper distance while the blades are changed. The opening and holding in place preferably is done with one hand to leave the other hand free for changing the blades.

Some utility knives use a compression spring (such as coil, butterfly, or leaf springs) to help lift the handle halves apart. Other knives may use a torsion spring to rotate the halves apart, instead of or in addition to a compression spring. The use of a torsion spring creates two problems in practice.

One problem is maintaining alignment of a torsion spring through many cycles of opening and closing. Incorporating a torsion spring into a knife handle so that it operates reliably and smoothly through many cycles requires precise manufacturing and assembly. This tends to make the knife too costly.

A second problem is that a spring strong enough to overcome the tendency of the handle halves to stick together is too strong to assure a controlled opening of the handle. If the handle becomes unstuck suddenly, the user can lose control of the knife, creating a risk of injury. Also, if the spring is strong enough to reliably open the handle, it will be more difficult for the user to reassemble the handle, because the user must work against the spring. On the other hand, if the spring is too weak, it will not be effective in opening the handle at all.

In general, the use of springs to assist opening of the handle adds complexity to the knife and makes it more difficult to retain the handle in the open position and to reassemble the handle. Springs may also increase the possibility that the user will lose control of the utility knife while opening it.

Thus, there is a need for a reliable means of assisting one-handed separation and opening of utility knife handles that overcomes the disadvantages of springs and does not add too much cost or complexity to the knife.

SUMMARY OF THE PRESENT INVENTION

Objects and Advantages

My invention can be used in any utility knife that uses separating handle halves to facilitate blade replacement. I make use of permanent magnets mounted in each half of the knife handle to separate the halves, rotate the halves to the desired open position, and to hold the halves in position while the blades are being changed. The permanent magnets act as a magnetic actuator for opening the handle halves.

My invention offers many advantages. Someone using a utility knife improved with my magnetic actuator will find it much easier and quicker to perform blade replacement, compared to prior art utility knives. My improved utility knife will open readily and reliably as soon as the handle connector is loosened, while being held in one hand. The magnets supply their maximum opening force while the handle is closed, just before being opened. As the handle rotates open, the rotational force supplied by my magnets decreases rapidly, so the handles do not accelerate to the open position too quickly. When the knife handle is fully open, my magnets supply a stabilizing force that retains the handle in the open position while the user performs the blade change operation. After the blade change, the handle is easily closed with one hand, allowing the user to tighten the handle connector with her free hand. A user of my improved knife will fumble less with the knife during blade replacement, and thereby avoid interruptions in mental concentration and work flow. A purchaser of my improved knife will find the cost is not substantially more than an unimproved knife. Furthermore, my improvement is reliable, rugged, and will last as long as any knife.

Theory of Operation

Unlike springs, a magnet can supply both attractive and repulsive forces. Also, the force supplied by a typical magnet is not relatively linear over its operating range, but diminishes rapidly with distance. These properties make magnets ideal for use as actuators for opening knife handles.

Permanent magnets are mounted opposite to one another in each knife handle half so that each magnet repels the other when knife handles are in the closed position. When the handle connector is loosened, each magnet repels the other, separating and rotating the handle halves. The magnet centers are offset slightly when the handle is closed, so that the repulsive magnetic force will operate to rotate the handles open in the same direction each time the handle connector is loosened. The magnetic force is strongest when the handle is closed, because the opposite poles of each magnet are closely adjacent to one another. As the handle rotates open, the magnets move apart and the magnetic force diminishes rapidly. When the handle is fully open, the magnets exert no force on one another or attract each other slightly, helping to hold the handles in the open position. The attractive force may be increased by mounting a ferrous metal landing in one or both handle halves, so that the landing is aligned with and attracts the magnet mounted in the opposite handle when the handle is in the open position.

DESCRIPTION OF PREFERRED EMBODIMENTS

Structure of Principle Embodiment

Figure 5:
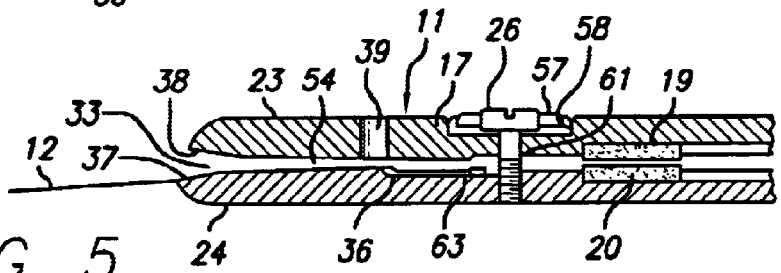
FIG. 5 is a partial cross-sectional view of a utility knife equipped with my invention.

The utility knife generally designated 11 is adapted for use with a replaceable thin elongated blade 12, such as a razor blade, having at least a first sharpened longitudinally extending edge 13 and preferably a second sharpened longitudinally extending edge 14. Thin elongated blade 12 preferably incorporates an elongated open center portion 16 with a long axis parallel to edges 13 and 14. The body 15 of utility knife 11 comprises two body sections 17 and 18, respectively having handle portions 21 and 22 and blade-holding portions 23 and 24. Connecting means 26 is provided for connecting the sections 17 and 18 together and is located adjacent the blade-holding portion 23 and 24. Connecting means 26 has a tightened position for clamping the blade 12 between the blade-holding portions 23 and 24. Means 26 preferably has a first loosened position permitting separation of the blade-holding portions 23 and 24 while securing sections 17 and 18 together and without permitting relative rotation of sections 17 and 18. When separated, blade-holding portions 23 and 24 preferably define a passageway 33 (FIG. 5) between the blade-holding portions for insertion and withdrawal of blade 12. To facilitate the formation of passageway 33, spring 61 is preferably provided to urge the blade-holding portions 23 and 24 apart when connecting means 26 is in its first loosened position.

Connecting means 26 is adapted to permit rotation of sections 17 and 18 when means 26 is adjusted to a rotatably loosened position. The rotatably loosened position of means 26 permits body sections 17 and 18 to rotate relative to one another around means 26. Means 26 secures section 17 to section 18 while they rotate about means 26. The rotatably loosened position is a second loosened position if means 26 is equipped with the preferable first loosened position. When means 26 is in its rotatably loosened position, body sections 17 and 18 may be rotated with respect to one another. In this manner quick and easy access is provided to expose spare blades 43 and blade 12, greatly facilitating substitution of blade 12 with a new blade taken from the recess 42.

Magnets 19 and 20 are mounted in body sections 17 and 18, respectively, so that magnets 19 and 20 repulse one another when body 15 is closed and connecting means 26 is in its tightened position. Magnets 19 and 20 are permanent dipole magnets preferably constructed from inexpensive ferrous materials, with a first magnetic pole centered on one major face of the magnet and an second and opposite magnetic pole centered on an opposite face. Magnet 19 is mounted in body section 17 so that its first magnetic pole faces the interior of body 15 when the knife is assembled. Magnet 20 is mounted in body section 18 in a corresponding fashion, with its first magnetic pole also facing the interior of body 15. When body sections 17 and 18 are assembled, magnets 19 and 20 are adjacent to one another with their magnetic poles having the same polarity opposite one another. Thus, magnets 19 and 20 repulse one another when body 15 is closed and connecting means 26 is in its tightened position. Magnets 19 and 20 are selected and positioned so that their repulsive force is sufficient to cause body sections 17 and 18 to rotate from an open position from a closed position when means 26 is in a rotatably loosened position. When sections 17 and 18 are rotated to their open position permitting access to spare blades 43, magnets 19 and 20 are positioned so that they no longer repulse one another, thereby stabilizing the sections in the open position.

Figure 3:
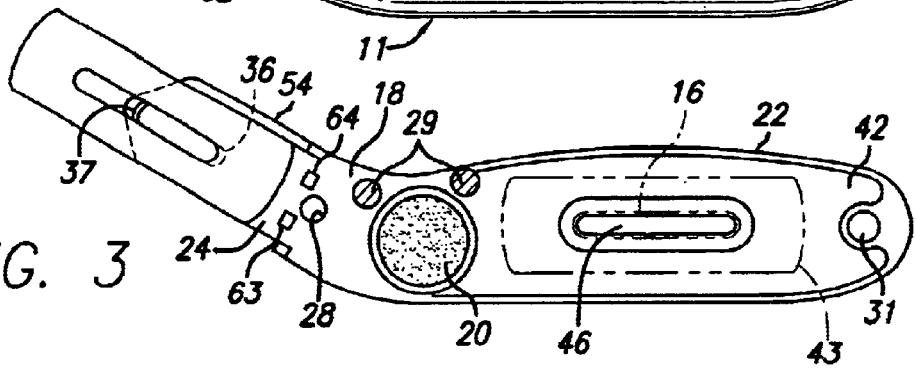
FIG. 3 is a view of the inside of a first handle portion of a utility knife equipped with a magnet according to my invention.

At least one of body sections 17 or 18 (in FIG. 3, shown in section 18) is preferably equipped with one or more ferrous metal landings 29. The ferrous metal in landings 29 attracts the magnet 19 in the opposite body section 17. Landings 29 are positioned so that their attractive force overcomes the repulsive forces between magnets 19 and 20 when body 15 is in the fully open position. This feature helps to stabilize the body sections 17 and 18 when the knife is opened, and eases handling of the knife during replacement of blade 12 with one of spare blades 43.

To guide blade 12 longitudinally through passageway 33 over a substantial length of the passageway on insertion and withdrawal and further to maintain the edges of blade 12 entirely within passageway 33 on insertion and withdrawal, blade-holding portion 24 is preferably formed with an internal elongated shoulder 36 extending longitudinally in passageway 33 and dimensioned to engage the blade open center portion 16. The other blade-holding portion 23 is preferably formed with a channel 50 for receiving shoulder 36 and with a flat face 51 for frictionally engaging blade 12 when connecting means 26 is in its tightened position. In addition to its guiding and positioning functions, shoulder 36 preferably defines a seated position for blade 12, which is held securely in its seated position by the aforementioned frictional engagement with flat face 51.

To direct blade 12 onto shoulder 36 when being inserted into passageway 33, it has been found advantageous to provide a ramp 37 at the end of shoulder 36. Preferably also the end 38 of the other blade-holding portion 23 is ramped opposite the ramp 37 to cooperate therewith to form a guiding opening for the blade to enter into passageway 33. As a further feature to assist the user in inserting the blade, one of the aforementioned ends is formed to protrude beyond the other to provide a lip for supporting and positioning an end of blade 12 before insertion into the passageway. This embodiment shows ramp 37 elongated. Another aid assisting the user in the proper insertion of the blade is a sight opening 39 in portion 23 affording visual verification of the positioning blade 12 in passageway 33. Sight opening 39 is in elongated form registering with and extending perpendicular to shoulder 36.

Figure 6:
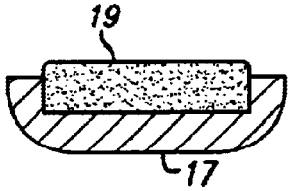
FIG. 6 is a cross-sectional view through the magnet and handle portion, drawn at about twice the scale of FIG. 4.

As an added safety feature, blade holding portions 23 and 24 may respectively include side flanges 53 and 54 dimensioned to provide a side wall for passageway 33 and positioned or offset sufficiently far from shoulder 36 to accommodate unimpeded motion and play of blade 12 as it is inserted into and withdrawn from the passageway. This feature is shown in FIG. 6. The side flanges 53 and 54 are provided to prevent the sharpened edges 13 and 14 of blade 12 from inadvertently and unexpectedly projecting through the sides of passageway 33 in the event blade 12 becomes misaligned during use. Flanges 53 and 54 are positioned far enough from shoulder 36 so that when blade 12 is inserted into the passageway and guided by shoulder 36, sharpened edges 13 and 14 will not touch the flanges, thereby preventing damage to the blade edges and injury to the user.

Connecting means 26 may comprise, as shown here, a screw mounted through an opening 27 in section 17 and threaded into an aligned opening 28 in section 18. Screw 26 may preferably be equipped with a compression spring 61 surrounding screw 26 and mounted in compression between the confronting inside surfaces of the sections. Spring 61 provides a force for opening the body 15 in addition to the repulsive forces supplied by magnets 19 and 20. The shank of screw 26 is provided with some clearance in opening 27 in section 17; this clearance, with spring 61, enables the spring to act as a fulcrum about which the sections may articulate in their longitudinal planes. Thus, manual compressive gripping of the handle portions while means 26 is in a first loosened position will separate the blade holding portions 23 and 24 for ready insertion and removal of blade 12.

To obviate the need for additional tools, such as a screw driver, to change blades, connecting means 26 is preferably provided with a manually engageable extension; such as D-ring 57 for applying torque to screw 26. The head of screw 26 preferably has a rubberized backing on its bottom surface facing body section 17, or equivalently the shank of screw 26 may be inserted through a rubber O-ring which is partially set in a recess in the bottom of the screw head, to hold connecting means 26 firmly in its tightened position.

If connecting means 26 protrudes from the body section too far it tends to snag or catch on carpeting. However, if it does not protrude far enough it cannot be operated without a tool. Therefore, a head of connecting means 26 is preferably set in a recessed portion 58 in body section 17. D-ring 57 is preferably connected to connecting means 26 so that it may stand upright as in FIG. 1 or it may lie in recess 58 as in FIG. 2. Its position in FIG. 1 is used for loosening and tightening of the connecting means 26 while its position in FIG. 2 is used for trimming carpet.

An abutment in the form of a pair of shoulders 63 and 64 is preferably formed as an integral part of body section 18 adjacent to screw 26. Shoulders 63 and 64 act as an indexing stop for the inner end 62 of blade 12 with the latter mounted in seated position registering the opening 16 therein with the shoulder 36 on blade-holding portion 24.

Figure 1:
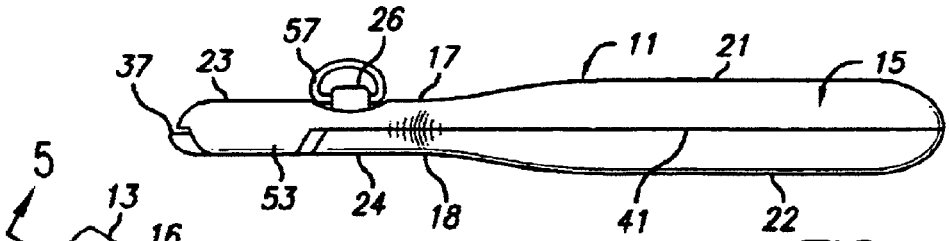
FIG. 1 is an edge view of a non-retractable blade utility knife equipped with my invention.
Figure 2:
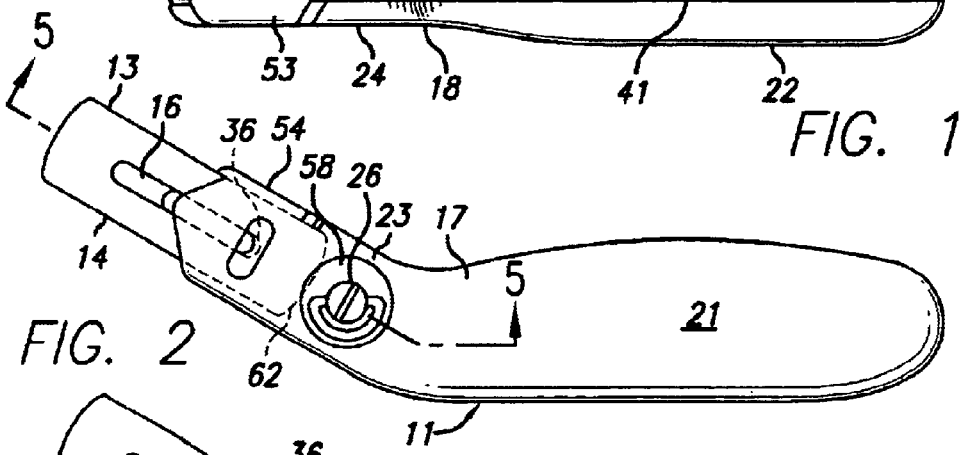
FIG. 2 is a side view of the utility knife shown in FIG. 1.
Figure 4:
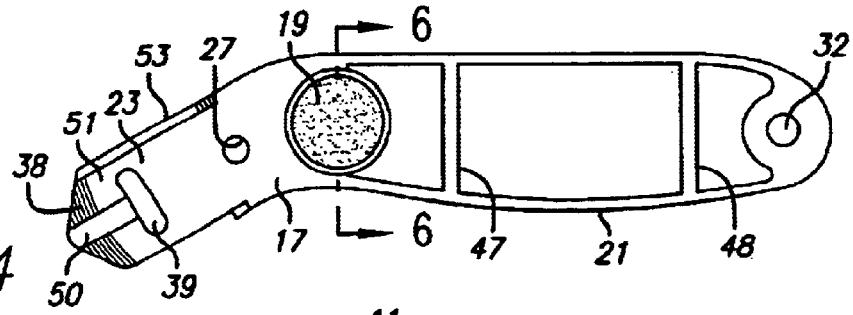
FIG. 4 is a view of a second handle portion of a utility knife equipped with a magnet according to my invention.

As will be observed from the drawings, sections 17 and 18 are formed for parting along a medial longitudinally extending plane, visible as parting line 41 in FIG. 1. One of the handle portions 22 is preferably formed with a recess 42 dimensioned to receive and store a plurality of spare blades 43, providing a blade storage compartment. A shoulder or stud 46 is preferably mounted centrally in recess 42 and is dimensioned for mounting through the blade open portions 16 for confining the transverse movement of the blades to within the area of the recess. Confining the transverse movement of the blades is important to prevent contact of the sharpened blade edges with the inner surfaces of handle portions 21 and 22, thereby preventing nicking or dulling the sharp edges. As an additional safety feature of the present invention, shoulder 46 preferably has a height extending across the plane of separation of the sections, for retention of blades thereon upon separation of the body sections 17 and 18. Accordingly, when the sections are separated to withdraw and insert a blade, all of the blades 43 in the storage compartment are positively retained against accidental escape. To assist in this regard, ribs 47 and 48 are preferably provided on handle portion 21, as seen in FIG. 4. Ribs 47 and 48 are preferably positioned substantially at the plane of separation to prevent movement of the blades from the upper end of shoulder 46 upon separation of the body sections.

The thread of screw 26 is preferably formed with a pitch permitting the connecting means to move from its tightened position to a first loosened position when the screw is advanced through about one revolution and further permitting the connecting means to move from its tightened position to a rotatably loosened position when the screw is turned through about two revolutions. Thus, with preferably one revolution of the screw, passageway 33 is preferably formed for insertion or withdrawal of blade 12. With preferably two revolutions of the screw the body sections 17 and 18 may be rotated to open the blade storage compartment.

Figure 7:
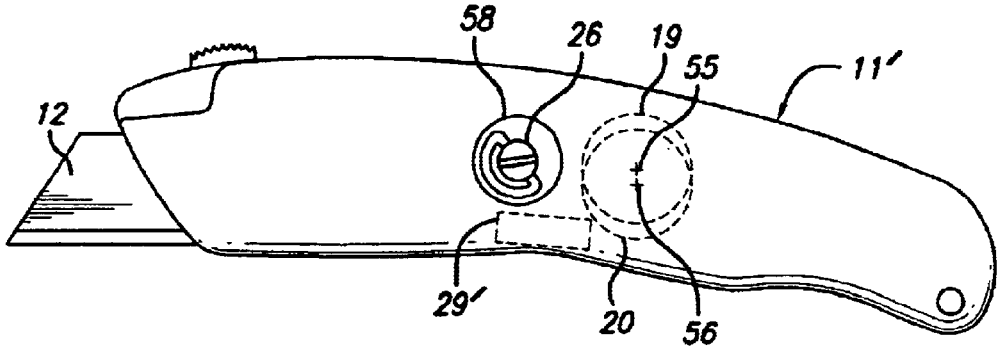
FIG. 7 is a side view of a retractable blade utility knife equipped with my invention.

When connecting means 26 is in a rotatably loosened position (preferably, after two rotations of screw 26), handle portions 21 and 22 are separated by the repulsive force of magnets 19 and 20. Magnetic centers 55 and 56 of magnets 19 and 20 are preferably offset slightly when body 15 is closed, as illustrated in FIG. 7. Therefore, magnets 19 and 20 preferably exert a lateral force that operates in the same direction each time screw 26 is loosened, thereby swinging handle portions 21 and 22 open in the same direction each time the handle is opened. Essentially, a slightly offset placement of magnets 19 and 20 ensures constant and predictable opening of handle portions 21 and 22 for access to spare blades 43, thereby easing the chore of blade replacement for the busy operator.

It is preferable to provide a boss 31 projecting from the distal end of one of the handle portions, here portion 22, and a recess 32 in the opposing handle portion 21 for receiving boss 31. The boss is long enough to prevent relative rotation of the body sections when the connecting means is in its first loosened position, thereby preventing accidental misalignment of passageway 33 under the gripping action applied to the handle portions. The boss length, however, must be limited enough to permit the relative rotation of the body sections when the connecting means is in its rotatably loosened position. The repulsive force of magnets 19 and 20 operate to separate handle portion 21 free and clear of handle portion 22, thereby assisting free rotation of body sections 17 and 18 with respect to one another.

If knife 11 is equipped with a connecting means 26 having the preferable first loosened position, to reverse a blade to expose a new cutting edge, it is only necessary to loosen the connecting means, preferably by one revolution of the screw. The blade may be easily withdrawn from the passageway 33, being guided only by the elongated internal shoulder 36 contacting the blade open center portion 16. Guided in this manner, the sharpened blade edges 13 and 14 will contact no internal surfaces of the knife blade holder. Consequently, they will not become nicked or dulled. The blade is then reversed and then inserted into the passageway again, the leading edge of the blade being guided onto the shoulder 36 by the ramps 37 and 38. When the blade reaches its seated position, connecting means 26 is easily tightened, typically with one revolution of the screw, to clamp the blade securely between blade holding portions 21 and 22 against thrusts or torque during use.

To open the knife for replacement of spare blades, connecting means 26 is adjusted to a rotatably loosened position, preferably by two revolutions of the screw. Blade holding portions 23 and 24 are separated by compression spring 61. Handle portions 21 and 22 are separated by magnetic forces from magnets 19 and 20 so that receiving boss 31 clears recess 32. Lateral magnetic forces from magnets 19 and 20 operate to rotate handle portions 21 and 22 away from one another around connecting means 26, which acts as a pivot point. Portions 21 and 22 rotate until blade storage compartment 42 and blade 12 are exposed. In this fully open position, magnets 19 and 20 are separated so that the lateral magnetic force of each magnet is negligible or zero. Ferrous metal landing 29 brakes the rotation of handle portions 21 and 22, if knife 11 is so equipped. In the alternative, side flanges 53 and 54 act as stops that prevent rotation of the sections past their desired open position. If there is no ferrous metal landing, shoulder, stop, or equivalent stopping mechanism, the user brakes the rotating sections manually. The desired blade replacement is performed by the user while body 15 is in the open position. The user then closes the body 15 by rotating sections 17 and 18 back into alignment and tightening connecting means 26.

My invention can be adapted for use with any utility knife that, like my knife described above, has two primary body sections comprising a handle and blade holder, a replaceable blade, and a pivot or hinge about which the two body sections rotate during blade replacement operations. Such a knife may, or may not, include a storage compartment for replacement blades. It may be of a retractable blade type or non-retractable blade type.

Figure 8:
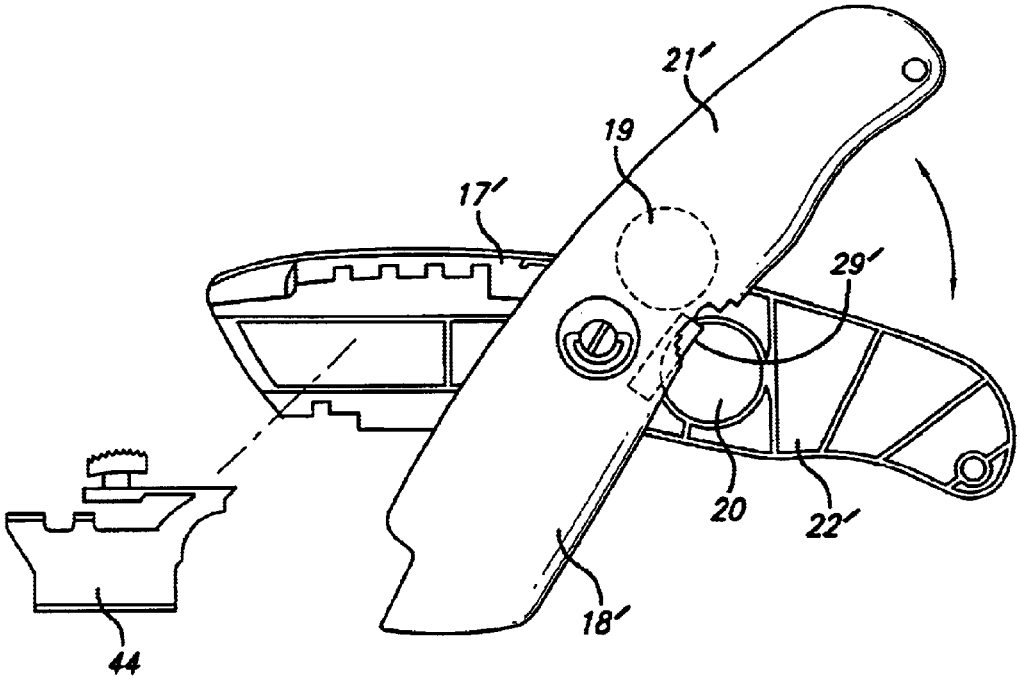
FIG. 8 is a side view of a retractable blade utility knife equipped with my invention, in the open position, with a partial breakaway view of a ferrous metal landing.

FIGS. 7 and 8 show the adaptation of my magnetic actuator to a utility knife of the retractable blade type. In this embodiment, the knife 11' does not have a blade storage compartment. Unlike my preferred adaptation using a non-retractable blade knife, knife 11' in FIGS. 7 and 8 incorporates a sliding blade holder 44 and other features that are not related to the operation of my invention. However, the construction and operation of my magnetic actuator, comprised of magnets 19 and 20 positioned within body sections 17' and 18', is essentially the same as in my preferred embodiment.

Referring to FIGS. 7 and 8, blade 12 is mounted in sliding blade holder 44 between body sections 17' and 18'. Connecting means 26 holds the body sections together. To replace blade 12, the user loosens connecting means 26 so that sections 17' and 18' are free to rotate about connecting means 26, which serves as a pivot. When connecting means 26 is loosened, magnets 19 and 20 exert repulsive forces upon one another. The repulsive magnetic forces separate handle portions 21' and 22' and rotate them around means 26 to an open position, shown in FIG. 8. When knife 11' is in a fully open position, magnets 19 and 20 are in a spaced apart position so that the repulsive magnetic force is negligible or zero. Sliding blade holder 44 and blade 12 are accessible for replacement of blade 12 when knife 11' is in the open position. Knife 11' is optionally equipped with ferrous metal landing 29' for braking the rotation of portions 21' and 22' and stabilizing them in the open position.

Thus, I have provided a magnetic actuator useful for improving many types of utility knives. My magnetic actuator eases the chore of blade replacement by making pivoting two piece handles found in many utility knives open smoothly and consistently. Professional users of utility knives, who must perform frequent changes of the knife blade during their jobs, will find my magnetic actuator particularly desirable. My magnetic actuator may be adapted at a low cost for use with a great variety of utility knife designs, thereby enhancing their operation and performance.

Various modifications and alterations of the embodiments of my invention will become apparent to those skilled in the art without departing from the scope of this invention. The scope of this invention is to be determined from the appended claims, and is not to be limited by the illustrative embodiments set forth herein.

What is claimed is:

1. A utility knife comprising:

a body comprising a first body section and a second body section, wherein said first body section comprises a first blade-holding portion, and said second body section comprises a second blade-holding portion;

a replaceable thin elongated blade disposed on at least one of said first body section and said second body section;

connecting means for connecting said first body section to said second body section, said connecting means permitting rotation of at least one of said first body section and said second body section between at least one closed position wherein said replaceable thin elongated blade is securely held by said utility knife, and at least one open position wherein said replaceable thin elongated blade is removably held by said utility knife;

a first magnet mounted in said first body section, and a second magnet mounted in said second body section, positioned to repulse said first magnet when said first body section and said second body section are in said at least one closed position.

2. The utility knife according to claim 1, further comprising at least one ferrous metal landing in at least one of said first body section and said second body section, said at least one ferrous metal landing positioned to attract an opposing one of said first magnet and said second magnet when said first body section and said second body section are in said at least one open position.

3. The utility knife according to claim 1, said first blade-holding portion having a first flange, and said second blade-holding portion having a second flange, and wherein said connecting means is adjustable to a non-rotatably loosened position permitting separation of said first blade holding portion from said second blade-holding portion to define a passageway while preventing rotation of said first body section and said second body section towards said at least one open position, wherein said passageway has an open end for slidable insertion and withdrawal of said blade into and out of said passageway and said first flange and said second flange are disposed to at least partly enclose said passageway.

4. The utility knife according to claim 3, wherein said connecting means is adjustable between (a) a tightened position wherein said first body section and said second body section are secured in said at least one closed position, (b) said non-rotatably loosened position, and (c) a rotatably loosened position wherein at least one of said first body section and said second body section is free to rotate to said at least one open position.

5. The utility knife according to claim 1, wherein said first body section and said second body section are formed to part along a medial longitudinally extending plane, said utility knife further comprising:

at least two handle portions forming a handle, wherein said first body section comprises a first handle portion of said at least two handle portions and said second body section comprises a second handle portion of said at least two handle portions; and a recess dimensioned to receive at least one replacement blade having the same size as said thin elongated blade, and positioned in at least one of said at least two handle portions to expose said replacement blade when said first body section and said second body section are in said at least one open position.

6. The knife according to claim 1, wherein said second magnet is positioned within said second body section so that said second magnet does not repulse said first magnet when said first body section and said second body section are in said at least one open position.

7. The utility knife according to claim 1, wherein said connecting means is adjustable between a tightened position wherein said first body section and said second body section are secured in said at least one closed position, and a rotatably loosened position wherein at least one of said first body section and said second body section is free to rotate to said at least one open position.

8. The utility knife according to claim 7, wherein said connecting means comprises a screw threaded into a selected one of said first body section and said second body section.

9. The utility knife according to claim 1, wherein said first magnet and said second magnet are configured to cause said at least one of said first body section and said second body section to rotate to said at least one open position from said at least one closed position when said connecting means is in said rotatably loosened position.

10. A utility knife, comprising:

a first body section, wherein said first body section comprises a first blade-holding portion and a first handle portion;

a second body section, wherein said second body section comprises a second blade-holding portion and a second handle portion;

a fastener fastening said first body section and said second body section together in pivoting relation permitting rotation between at least one closed position wherein said first and second blade-holding portions together comprise a blade holder and said first and second handle portions together comprise a handle connected to said blade holder, and at least one open position wherein said second blade-holding portion is disposed substantially away from said first blade-holding portion;

a replaceable thin elongated blade retained in said blade holder, said blade having at least one exposed cutting edge;

a first magnet mounted in said first body section, and a second magnet mounted in said second body section, positioned to repulse said first magnet when said first body section and said second body section are in said at least one closed position.

11. The utility knife according to claim 10, further comprising at least one ferrous metal landing in at least one of said first body section and said second body section, said at least one ferrous metal landing positioned to attract an opposing one of said first magnet and said second magnet when said first body section and said second body section are in said at least one open position.

12. The utility knife according to claim 10, further comprising a recess dimensioned to receive at least one replacement blade having the same size as said thin elongated blade, and positioned in at least one of said first and second handle portions to expose said replacement blade when said first body section and said second body section are in said at least one open position.

13. The utility knife according to claim 10, wherein said fastener is adjustable between a tightened position securing said first body section and said second body section in said at least one closed position, and a loosened position permitting rotation of at least one of said first body section and said second body section.

14. The utility knife according to claim 13, wherein said first magnet and said second magnet are configured to cause at least one of said first body section and said second body section to rotate to said at least one open position from said at least one closed position when said fastener is in said loosened position.

15. A pivoting handle of a utility knife, said handle comprising:

a first body section, wherein said first body section comprises a first handle portion;

a second body section, wherein said second body section comprises a second handle portion;

a fastener fastening said first body section and said second body section together in pivoting relation permitting rotation between at least one closed position wherein said first and second handle portions together comprise a graspable handle, and at least one open position wherein said second handle portion is disposed substantially away from said first handle portion; for receiving at least one replacement blade;

a first magnet mounted in said first body section, and a second magnet mounted in said second body section, positioned to repulse said first magnet when said first body section and said second body section are in said at least one closed position for receiving at least one replacement blade.

16. The pivoting handle according to claim 15, further comprising at least one ferrous metal landing in at least one of said first body section and said second body section, said at least one ferrous metal landing positioned to attract an opposing one of said first magnet and said second magnet when said first body section and said second body section are in said at least one open position.

17. The pivoting handle according to claim 15, further comprising a recess dimensioned to receive said at least one replacement blade, and positioned in at least one of said first and second handle portions to expose said replacement blade when said first body section and said second body section are in said at least one open position.

18. The pivoting handle according to claim 15, wherein said fastener is adjustable between a tightened position securing said first body section and said second body section in said at least one closed position, and a loosened position permitting rotation of at least one of said first body section and said second body section.

19. The pivoting handle according to claim 18, wherein said first magnet and said second magnet are configured to cause at least one of said first body section and said second body section to rotate to said at least one open position from said at least one closed position when said fastener is in said loosened position.

* * * * *